US011401906B2

(12) United States Patent
Soda et al.

(10) Patent No.: US 11,401,906 B2
(45) Date of Patent: Aug. 2, 2022

(54) ENGINE DRIVING APPARATUS

(71) Applicant: SUBARU CORPORATION, Tokyo (JP)

(72) Inventors: Yoshinori Soda, Tokyo (JP); Naoki Furune, Tokyo (JP); Yuta Okada, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 16/837,380

(22) Filed: Apr. 1, 2020

(65) Prior Publication Data

US 2020/0392932 A1 Dec. 17, 2020

(30) Foreign Application Priority Data

Jun. 11, 2019 (JP) ..... JP2019-108745

(51) Int. Cl.

| | |
|---|---|
| ***F02N 19/00*** | (2010.01) |
| ***F02N 11/08*** | (2006.01) |
| ***F02B 75/18*** | (2006.01) |
| ***F02D 13/00*** | (2006.01) |
| ***F02D 41/06*** | (2006.01) |

(52) U.S. Cl.

CPC ..... *F02N 19/005* (2013.01); *F02B 75/18* (2013.01); *F02D 13/00* (2013.01); *F02D 41/062* (2013.01); *F02N 11/0862* (2013.01); *F02N 2019/007* (2013.01); *F02N 2019/008* (2013.01); *F02N 2200/021* (2013.01); *F02N 2200/045* (2013.01); *F02N 2200/06* (2013.01)

(58) Field of Classification Search

None

See application file for complete search history.

(56) References Cited

U.S. PATENT DOCUMENTS

| | | | | |
|---|---|---|---|---|
| 6,335,574 | B1 * | 1/2002 | Ochiai | B60L 3/0046 290/40 C |
| 6,851,404 | B2 * | 2/2005 | Kojima | F02D 41/062 123/179.5 |
| 6,877,470 | B2 * | 4/2005 | Mitani | F02N 99/006 123/179.5 |
| 7,191,746 | B2 * | 3/2007 | Nakamura | F02N 19/005 123/179.3 |

(Continued)

FOREIGN PATENT DOCUMENTS

| | | | | |
|---|---|---|---|---|
| DE | 102009004901 | A1 * | 8/2009 | F02D 41/0097 |
| DE | 102009004901 | A8 * | 11/2009 | F02D 41/0097 |

(Continued)

*Primary Examiner* — Kevin R Steckbauer

(74) *Attorney, Agent, or Firm* — McGinn I.P. Law Group, PLLC.

(57) ABSTRACT

An engine driving apparatus includes an engine, a starter motor, and a starter motor controller. The engine includes a plurality of cylinders. When any one of the plurality of cylinders enters a compression stroke, another one of the cylinders enters an expansion stroke. The starter motor is coupled to a crankshaft of the engine. The starter motor controller is configured to control the starter motor. Before restarting the engine, the starter motor controller performs pre-restart control for adding torque to the crankshaft by using the starter motor to open an exhaust valve of the cylinder in the expansion stroke.

20 Claims, 3 Drawing Sheets

(56) References Cited

U.S. PATENT DOCUMENTS

| | | | | |
|---|---|---|---|---|
| 7,913,548 | B2 * | 3/2011 | Ono | F02D 41/0097 73/114.25 |
| 8,763,580 | B2 * | 7/2014 | Belau | F02N 19/005 123/179.3 |
| 10,006,430 | B2 * | 6/2018 | Kojima | B60K 6/48 |
| 10,465,624 | B2 * | 11/2019 | Suzuki | F02D 41/1444 |
| 2004/0060530 | A1 * | 4/2004 | Mitani | F02N 11/08 123/179.3 |
| 2004/0226530 | A1 * | 11/2004 | Kojima | F02N 19/005 123/179.3 |
| 2007/0062470 | A1 * | 3/2007 | Ashizawa | F02D 41/3023 123/90.15 |
| 2007/0062476 | A1 * | 3/2007 | Ota | F02B 23/104 123/179.4 |
| 2007/0131188 | A1 * | 6/2007 | Hokuto | F02B 17/005 123/431 |
| 2009/0183557 | A1 * | 7/2009 | Ono | F02D 41/0097 73/114.25 |
| 2010/0275872 | A1 * | 11/2010 | Belau | F02N 99/004 123/179.16 |
| 2016/0003207 | A1 * | 1/2016 | Kojima | F02N 19/001 180/65.265 |
| 2018/0112610 | A1 * | 4/2018 | Suzuki | F02D 41/065 |
| 2019/0226440 | A1 * | 7/2019 | Murakami | H02P 9/48 |
| 2020/0392932 | A1 * | 12/2020 | Soda | F02N 11/0862 |

FOREIGN PATENT DOCUMENTS

| | | | | | |
|---|---|---|---|---|---|
| JP | 2003-113763 | A | | 4/2003 | |
| JP | 2004301081 | A | * | 10/2004 | |
| JP | 2009167996 | A | * | 7/2009 | F02D 41/0097 |
| JP | 4849074 | B2 | * | 12/2011 | F02D 41/0097 |
| JP | 2017219019 | A | * | 12/2017 | F02D 41/0097 |

* cited by examiner

ENGINE DRIVING APPARATUS

CROSS-REFERENCE TO RELATED APPLICATIONS

The present application claims priority from Japanese Patent Application No. 2019-108745 filed on Jun. 11, 2019, the entire contents of which are hereby incorporated by reference.

BACKGROUND

The disclosure relates to an engine driving apparatus.

Japanese Unexamined Patent Application Publication (JP-A) No. 2003-113763 discloses restart of an engine by using a starter motor after idle reduction. In JP-A No. 2003-113763, in order to reduce power consumption at the time of engine restart, power to be supplied to the starter motor is reduced for a predetermined period.

SUMMARY

An aspect of the disclosure provides an engine driving apparatus including an engine, a starter motor, and a starter motor controller. The engine includes a plurality of cylinders. When any one of the plurality of cylinders enters a compression stroke, another one of the cylinders enters an expansion stroke. The starter motor is coupled to a crankshaft of the engine. The starter motor controller is configured to control the starter motor. Before restarting the engine, the starter motor controller performs pre-restart control for adding torque to the crankshaft by using the starter motor to open an exhaust valve of the cylinder in the expansion stroke.

An aspect of the disclosure provides an engine driving apparatus including an engine, a starter motor, and circuitry. The engine includes a plurality of cylinders. When any one of the plurality of cylinders enters a compression stroke, another one of the cylinders enters an expansion stroke. The starter motor is coupled to a crankshaft of the engine. The circuitry is configured to control the starter motor, and before restarting the engine, perform pre-restart control for adding torque to the crankshaft by using the starter motor to open an exhaust valve of the cylinder in the expansion stroke.

BRIEF DESCRIPTION OF THE DRAWINGS

The accompanying drawings are included to provide a further understanding of the disclosure and are incorporated in and constitute a part of this specification. The drawings illustrate an example embodiment and, together with the specification, serve to explain the principles of the disclosure.

DETAILED DESCRIPTION

The output of a starter motor decreases by an increase in the temperature of the starter motor and aging degradation of a battery. In addition, energy for restarting an engine changes depending on a status of the engine. For example, energy for a compression stroke and an expansion stroke (combustion stroke) of the engine is larger than energy for an intake stroke and an exhaust stroke of the engine.

Thus, if the output of the starter motor is low, in a state where the engine during idle reduction is in a compression stroke or an expansion stroke, it has not been possible to restart the engine by using the starter motor in some cases.

Accordingly, it is desirable to provide an engine driving apparatus capable of restarting an engine even if the output of a starter motor is low.

Figure 1:
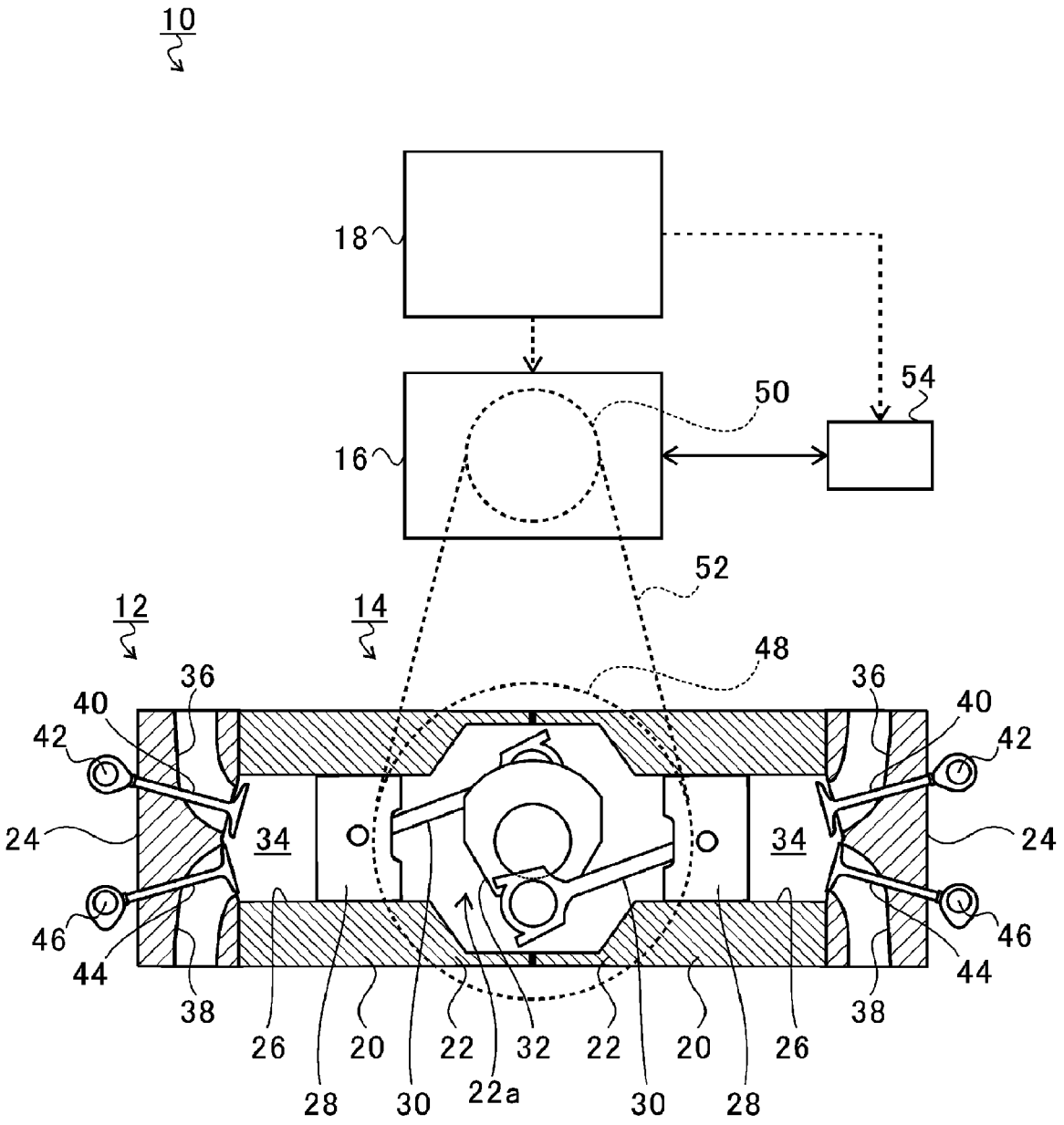
FIG. 1 schematically illustrates a configuration of an engine driving apparatus.

In the following, an embodiment of the disclosure is described in detail with reference to the accompanying drawings. Note that the following description is directed to an illustrative example of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiment which are not recited in a most-generic independent claim of the disclosure are optional and may be provided on an as-needed basis. The drawings are schematic and are not intended to be drawn to scale. Throughout the present specification and the drawings, elements having substantially the same function and configuration are denoted with the same numerals to avoid any redundant description. FIG. 1 schematically illustrates a configuration of an engine driving apparatus 10. In FIG. 1, the solid arrow represents a flow of power, and the dotted arrow represents a flow of signals. The engine driving apparatus 10 is installed in a vehicle. As illustrated in FIG. 1, the engine driving apparatus 10 includes an engine 12, a belt mechanism 14, a generator motor (starter motor) 16, and an engine control unit (ECU) 18.

The engine 12 is a four-stroke engine in which an intake stroke, a compression stroke, an expansion stroke (combustion stroke), and an exhaust stroke are performed as a cycle and are performed repeatedly. Note that the engine 12 is a horizontally opposed engine in the embodiment. However, the engine 12 is not limited to this and may be an inline engine or a V engine.

The engine 12 includes two (plural) cylinder blocks 20, two (plural) crankcases 22, and two (plural) cylinder heads 24. In the cylinder blocks 20, a plurality of cylinders 26 are formed. In the embodiment, two cylinders 26 are formed in each of the cylinder blocks 20. Thus, four cylinders 26 are formed in total in the two cylinder blocks 20. FIG. 1 illustrates two cylinders 26 of the four cylinders 26.

In each of the cylinders 26, a piston 28 is disposed. The piston 28 can move slidingly within the cylinder 26. To the piston 28, a connecting rod 30 is coupled. The piston 28 is supported by the connecting rod 30.

The crankcases 22 and the cylinder blocks 20 are formed in a single form. Alternatively, the crankcases 22 and the cylinder blocks 20 may be formed in separate forms. In the crankcases 22, a crank chamber 22*a* is formed. A crankshaft 32 is supported in the crank chamber 22*a* in a rotatable manner. The connecting rods 30 are coupled to the crankshaft 32, and the pistons 28 are coupled to the crankshaft 32 via the connecting rods 30.

Each of the cylinder heads 24 is coupled to a side of a corresponding one of the cylinder blocks 20 opposite to a corresponding one of the crankcases 22. A space surrounded by an inner wall surface of each of the cylinder heads 24, an inner wall surface of each of the cylinders 26, and a top surface of each of the pistons 28 is formed as a combustion chamber 34.

For each of the cylinder heads 24, an intake port 36 and an exhaust port 38 are formed. The intake port 36 and the exhaust port 38 communicate with the combustion chambers 34. Between the intake port 36 and each of the combustion chambers 34, an umbrella of an intake valve 40 is disposed. The intake valve 40 moves as a camshaft 42 rotates, and opens or closes the intake port 36 with respect to the combustion chambers 34.

Between the exhaust port 38 and each of the combustion chambers 34, an umbrella of an exhaust valve 44 is disposed. The exhaust valve 44 moves as a camshaft 46 rotates, and opens or closes the exhaust port 38 with respect to the combustion chambers 34.

For each of the cylinder heads 24, an injector and a spark plug (which are not illustrated) are disposed. The injector injects fuel into the combustion chamber 34. The spark plug discharges electricity at a predetermined timing so as to ignite a mixture of an intake air and fuel.

The mixture of an intake air and fuel is combusted by spark of the spark plug. The combustion causes the piston 28 to reciprocate within the cylinder 26, and the reciprocation of the piston 28 is converted into rotation of the crankshaft 32 via the connecting rod 30.

The belt mechanism 14 is coupled to the crankshaft 32. The belt mechanism 14 includes a large pulley 48, a small pulley 50, and a belt 52. The large pulley 48 is coupled to the crankshaft 32. The small pulley 50 is coupled to a rotary shaft of the generator motor 16. The belt 52 is stretched between the large pulley 48 and the small pulley 50.

The generator motor 16 is a so-called integrated starter generator (ISG) that functions as a generator (starter) and a motor. When the crankshaft 32 rotates, the small pulley 50 and the rotary shaft of the generator motor 16 are rotationally driven via the belt 52. In this case, the generator motor 16 functions as a motor driven by the crankshaft 32.

In addition, rotation of the rotary shaft of the generator motor 16 rotationally drives the large pulley 48 and the crankshaft 32 via the belt 52. In this case, the generator motor 16 functions as a motor that drives the crankshaft 32. In the embodiment, the generator motor 16 is coupled to the crankshaft 32 via the belt mechanism 14. However, the generator motor 16 may be directly coupled to the crankshaft 32.

The generator motor 16 is electrically connected to a battery 54. When the generator motor 16 functions as a generator, power generated by the generator motor 16 is supplied to the battery 54. In addition, when the generator motor 16 functions as a motor, the battery 54 supplies power to the generator motor 16.

Figure 2:
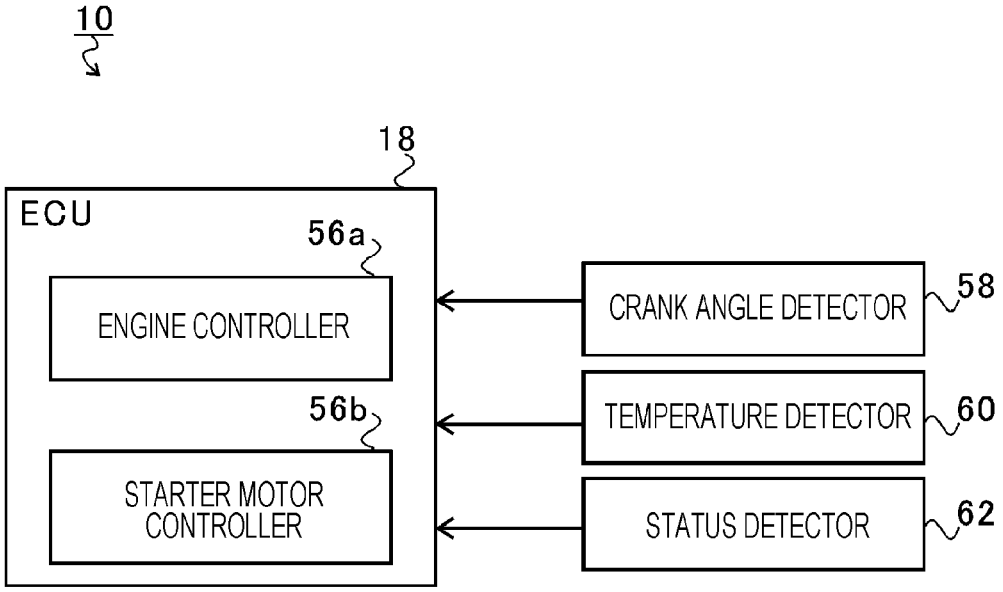
FIG. 2 is a block diagram schematically illustrating a configuration of an ECU.

FIG. 2 is a block diagram schematically illustrating a configuration of the ECU 18. The ECU 18 is a microcomputer including a central processing unit (CPU), a read-only memory (ROM) storing a program and the like, a random access memory (RAM) as a work area, and the like, and generally controls the engine driving apparatus 10. In the embodiment, the ECU 18 functions as an engine controller 56*a* and a starter motor controller 56*b*.

As illustrated in FIG. 2, the engine driving apparatus 10 includes a crank angle detector 58, a temperature detector 60, and a status detector 62. The crank angle detector 58 is a sensor that is disposed near the crankshaft 32 (see FIG. 1) and that detects a crank angle (rotation angle) of the crankshaft 32. The crank angle detector 58 outputs a detection signal to the engine controller 56*a* and the starter motor controller 56*b*.

The temperature detector 60 is a sensor that is disposed in the generator motor 16 (see FIG. 1) and that detects the temperature of the generator motor 16. The temperature detector 60 outputs a detection signal to the engine controller 56*a* and the starter motor controller 56*b*. The status detector 62 is a sensor that is disposed in the battery 54 (see FIG. 1) and that detects a degradation status of the battery 54. The status detector 62 outputs a detection signal to the engine controller 56*a* and the starter motor controller 56*b*. Herein, as the battery 54 is degraded, the resistance of the battery 54 increases. Thus, as the degradation status (degree of degradation) of the battery 54, the status detector 62 detects the resistance of the battery 54.

The engine controller 56*a* controls the engine 12. In the embodiment, the engine controller 56*a* can cause the engine 12 to implement idle reduction or to restart.

The starter motor controller 56*b* controls the generator motor 16 and the battery 54 (see FIG. 1). For example, at restart of the engine 12 after idle reduction, the starter motor controller 56*b* causes the battery 54 to supply power to the generator motor 16 to drive the generator motor 16 as a motor. Thus, the starter motor controller 56*b* can restart the engine 12. In addition, when a vehicle transitions from EV mode to HV mode, the starter motor controller 56*b* can cause the battery 54 to supply power to the generator motor 16 to drive the generator motor 16 as a motor. Thus, the starter motor controller 56*b* can restart the engine 12.

Energy (torque) for restarting the engine 12 changes depending on a status of the engine 12. For example, energy for a compression stroke and an expansion stroke of the engine 12 is larger than energy for an intake stroke and an exhaust stroke of the engine 12.

The engine 12 has a configuration in which, when any one of the plurality of cylinders 26 enters a compression stroke, another one of the cylinders 26 enters an expansion stroke. When a cylinder 26 enters a compression stroke, the intake valve 40 is at a position for closing the intake port 36 (in a closed state), and the exhaust valve 44 is at a position for closing the exhaust port 38 (in a closed state). In addition, the piston 28 of the cylinder 26 travels therein toward the intake valve 40 and the exhaust valve 44.

In this case, the air in the combustion chamber 34 of the cylinder 26 is compressed by the piston 28 with the intake valve 40 and the exhaust valve 44 in a closed state, and the pressure in the combustion chamber 34 becomes a positive pressure. Thus, energy for the compression stroke of the engine 12 is larger than that for the intake stroke, in which the intake valve 40 of the engine 12 is open, and the exhaust stroke, in which the exhaust valve 44 is open.

Similarly, when the cylinder 26 enters an expansion stroke, the intake valve 40 is at a position for closing the intake port 36 (in a closed state), and the exhaust valve 44 is at a position for closing the exhaust port 38 (in a closed state). In addition, the piston 28 of the cylinder 26 travels therein to be away from the intake valve 40 and the exhaust valve 44.

In this case, the combustion chamber 34 of the cylinder 26 is increased (expanded) by the piston 28 with the intake valve 40 and the exhaust valve 44 in a closed state, and the pressure in the combustion chamber 34 becomes a negative pressure. Thus, energy for the expansion stroke of the engine 12 is larger than that for the intake stroke, in which the intake valve 40 of the engine 12 is open, and the exhaust stroke, in which the exhaust valve 44 is open.

In addition, the output of the generator motor 16 changes depending on a temperature status of the generator motor 16 and a degradation status of the battery 54. For example, the output of the generator motor 16 decreases as the temperature of the generator motor 16 increases, and as the battery 54 is degraded over time.

Thus, if the output of the generator motor 16 is low, in a state where the engine 12 during idle reduction (while driving of the engine 12 is stopped) is in a compression stroke or an expansion stroke, it has not been possible to restart the engine 12 by using the generator motor 16 in some cases. In such cases, even if replacement of the battery 54 is unnecessary, the battery 54 has been replaced with a new battery 54 in order to increase the output of the generator motor 16.

Thus, in the embodiment, the starter motor controller 56*b* performs a process (hereinafter referred to as pre-restart control) for reducing energy for restarting the engine 12 while driving of the engine 12 is stopped (during idle reduction). The pre-restart control will be described below in detail.

Before restarting the engine 12 (i.e., while driving of the engine 12 is stopped), the starter motor controller 56*b* obtains signals output from the crank angle detector 58, the temperature detector 60, and the status detector 62.

On the basis of the obtained signals, the starter motor controller 56*b* determines whether it is possible to perform the pre-restart control. First, on the basis of signals output from the temperature detector 60 and the status detector 62, the starter motor controller 56*b* derives the temperature of the generator motor 16 and a degree of degradation of the battery 54. On the basis of the derived temperature of the generator motor 16 and degree of degradation of the battery 54, the starter motor controller 56*b* derives a predetermined threshold for a crank angle of the engine 12.

In the embodiment, the ECU 18 stores a threshold map in a memory (not illustrated). Referring to the threshold map stored in the memory, the starter motor controller 56*b* derives the threshold. Herein, the threshold is set for each predetermined crank angle region. The threshold set for each predetermined crank angle region is variable depending on the temperature of the generator motor 16 and the degree of degradation of the battery 54. As the temperature of the generator motor 16 is higher, a higher threshold is set. In addition, as the degree of degradation (resistance) of the battery 54 is higher, a higher threshold is set.

On the basis of a signal output from the crank angle detector 58, the starter motor controller 56*b* derives the crank angle of the engine 12 and compares the derived crank angle and the threshold with each other. If the derived crank angle is within a predetermined crank angle region and is equal to or less than the threshold set for the crank angle region, the starter motor controller 56*b* determines to perform the pre-restart control. If the derived crank angle is within the predetermined crank angle region and is greater than the threshold set for the crank angle region, the starter motor controller 56*b* determines not to perform the pre-restart control.

Figure 3:
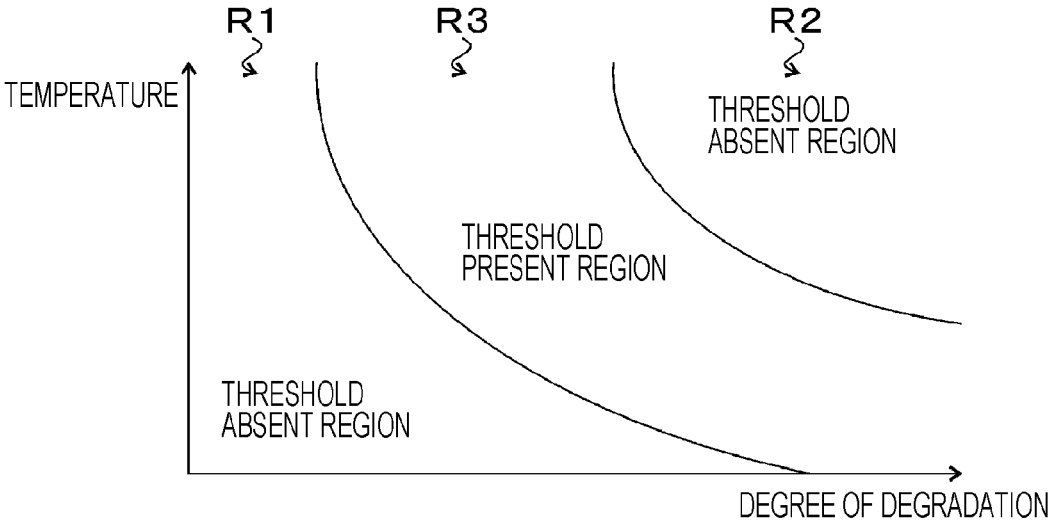
FIG. 3 illustrates an example of a threshold map to be stored in a memory.

FIG. 3 illustrates an example of the threshold map stored in the memory. In FIG. 3, the vertical axis represents the temperature of the generator motor 16, and the horizontal axis represents the degree of degradation of the battery 54. As illustrated in FIG. 3, in the threshold map, no threshold is set in a region R1 (threshold absent region) where the temperature of the generator motor 16 and the degree of degradation of the battery 54 are relatively low.

If the starter motor controller 56*b* determines that the temperature of the generator motor 16 and the degree of degradation of the battery 54 are within the region R1 (second region) in the threshold map, the starter motor controller 56*b* determines not to perform the pre-restart control regardless of the crank angle of the engine 12. If the temperature of the generator motor 16 and the degree of degradation of the battery 54 are relatively low, the engine 12 can be restarted with ease without performing the pre-restart control.

Also, as illustrated in FIG. 3, in the threshold map, no threshold is set in a region R2 (threshold absent region) where the temperature of the generator motor 16 and the degree of degradation of the battery 54 are relatively high.

If the starter motor controller 56*b* determines that the temperature of the generator motor 16 and the degree of degradation of the battery 54 are within the region R2 (third region) in the threshold map, the starter motor controller 56*b* determines not to perform the pre-restart control regardless of the crank angle of the engine 12.

If the temperature of the generator motor 16 and the degree of degradation of the battery 54 are relatively high, the output of the generator motor 16 becomes less than energy for driving (restarting) the engine 12. In this case, it is not possible to drive (restart) the engine 12 by using the generator motor 16 regardless of the crank angle of the engine 12. Thus, if it is determined that the temperature of the generator motor 16 and the degree of degradation of the battery 54 are within the region R2 in the threshold map, the engine controller 56*a* does not perform a process for temporarily stopping the engine 12 (i.e., idle reduction). Since idle reduction is not implemented, the starter motor controller 56*b* does not restart the engine 12, and accordingly, the pre-restart control is not performed. Thus, if the starter motor controller 56*b* determines that the temperature of the generator motor 16 and the degree of degradation of the battery 54 are within the region R2 in the threshold map, the starter motor controller 56*b* determines not to perform the pre-restart control.

In addition, as illustrated in FIG. 3, in the threshold map, a threshold is set in a region R3 (threshold present region) between the region R1 and the region R2. Herein, in the region R1 (second region), the temperature of the generator motor 16 and the degree of degradation of the battery 54 are lower than those in the region R3 (predetermined first region). In the region R2 (third region), the temperature of the generator motor 16 and the degree of degradation of the battery 54 are higher than those in the region R3 (predetermined first region). If the starter motor controller 56*b* determines that the temperature of the generator motor 16 and the degree of degradation of the battery 54 are within the region R3 in the threshold map, on the basis of the temperature of the generator motor 16 and the degree of degradation of the battery 54, the starter motor controller 56*b* derives the threshold. The starter motor controller 56*b* compares the derived threshold and the crank angle with each other to determine whether it is possible to perform the pre-restart control. For example, if the derived crank angle is less than the threshold, the starter motor controller 56*b* determines to perform the pre-restart control, and if the derived crank angle is greater than the threshold, the starter motor controller 56*b* determines not to perform the pre-restart control.

If the starter motor controller 56*b* determines to perform the pre-restart control, the starter motor controller 56*b* drives the generator motor 16 and rotates the crankshaft 32 in a direction to increase the crank angle (hereinafter referred to as forward rotation). The embodiment will describe a case in which, when the starter motor controller 56*b* performs the pre-restart control, the piston 28 (crank angle) within the cylinder 26 in a compression stroke is at the bottom dead center, and the piston 28 (crank angle) within the cylinder 26 in an expansion stroke is at the top dead center.

Figure 4:
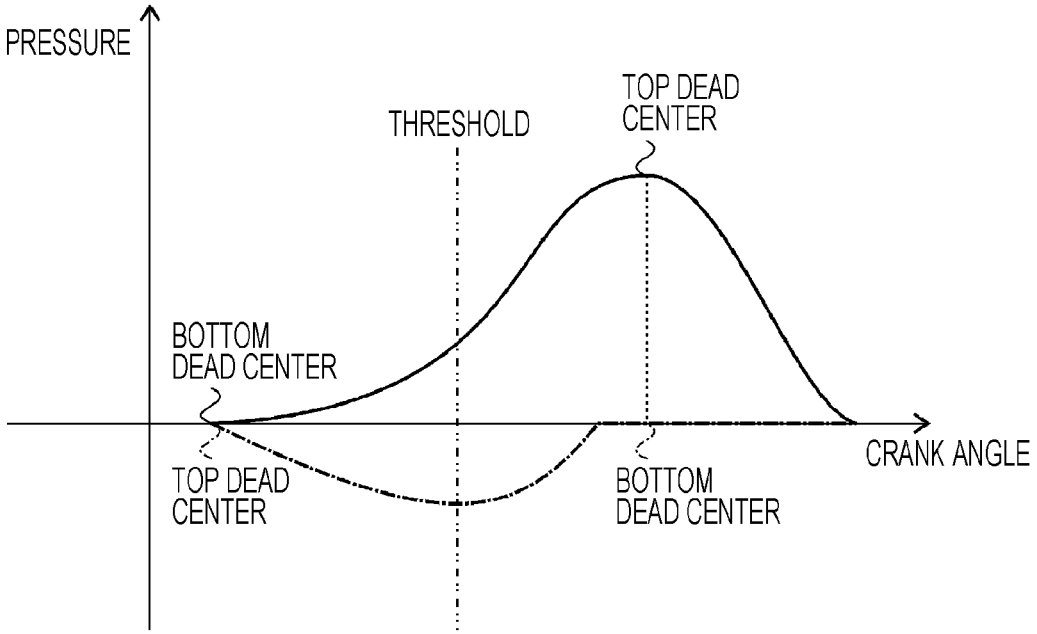
FIG. 4 illustrates relationships between a crank angle of an engine and a pressure in a combustion chamber while driving of the engine is stopped.

FIG. 4 illustrates relationships between the crank angle of the engine 12 and the pressure in the combustion chamber 34 while driving of the engine 12 is stopped. In FIG. 4, the vertical axis represents the pressure in the combustion chamber 34, and the horizontal axis represents the crank angle of the engine 12. In addition, in FIG. 4, the solid line represents a relationship between the crank angle of the engine 12 and the pressure in the combustion chamber 34 of a cylinder 26 in a compression stroke, and the chain line represents a relationship between the crank angle of the engine 12 and the pressure in the combustion chamber 34 of a cylinder 26 in an expansion stroke.

As illustrated by the solid line in FIG. 4, as the crank angle in the compression stroke is increased (to approach the top dead center from the bottom dead center), the pressure in the combustion chamber 34 is increased (i.e., positive pressure is increased). In addition, as illustrated by the chain line in FIG. 4, as the crank angle in the expansion stroke is increased (to approach the bottom dead center from the top dead center), the pressure in the combustion chamber 34 is decreased (i.e., negative pressure is increased).

Herein, before the crank angle in the expansion stroke reaches the bottom dead center, the exhaust valve 44 (see FIG. 1) enters an open state from a closed state. Thus, air flows into the combustion chamber 34 of the cylinder 26 in the expansion stroke. As a result, as illustrated by the chain line in FIG. 4, the pressure in the combustion chamber 34 of the cylinder 26 in the expansion stroke is increased (negative pressure is decreased) before the crank angle reaches the bottom dead center.

In this case, the starter motor controller 56*b* stops driving the generator motor 16. That is, the starter motor controller 56*b* drives the generator motor 16 until the exhaust valve 44 of the cylinder 26 in the expansion stroke opens. When the exhaust valve 44 opens, the starter motor controller 56*b* stops driving the generator motor 16. In response to the stop of driving the generator motor 16, the pressure (positive pressure) in the combustion chamber 34 of the cylinder 26 in the compression stroke causes the crankshaft 32 to rotate in such a direction that the crank angle is decreased (hereinafter referred to as reverse rotation).

Figure 5:
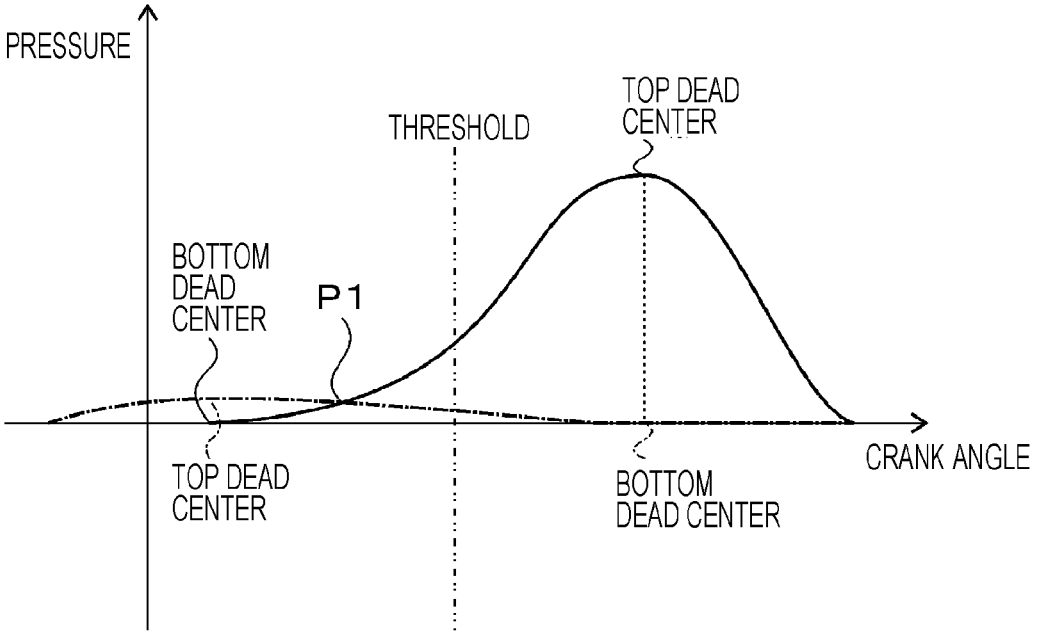
FIG. 5 illustrates relationships between the crank angle of the engine and the pressure in the combustion chamber during reverse rotation of a crankshaft.

FIG. 5 illustrates relationships between the crank angle of the engine 12 and the pressure in the combustion chamber 34 during reverse rotation of the crankshaft 32. In FIG. 5, the vertical axis represents the pressure in the combustion chamber 34, and the horizontal axis represents the crank angle of the engine 12. In addition, in FIG. 5, the solid line represents a relationship between the crank angle of the engine 12 and the pressure in the combustion chamber 34 of a cylinder 26 in a compression stroke, and the chain line represents a relationship between the crank angle of the engine 12 and the pressure in the combustion chamber 34 of a cylinder 26 in an expansion stroke.

When the crankshaft 32 is reversely rotated, the exhaust valve 44 (see FIG. 1) of the cylinder 26 in the expansion stroke enters a closed state from an open state. After the exhaust valve 44 has entered the closed state, when the crankshaft 32 is reversely rotated, the air in the combustion chamber 34 of the cylinder 26 in the expansion stroke is compressed. Thus, as illustrated by the chain line in FIG. 5, as the crank angle in the expansion stroke is decreased (to approach the top dead center from the bottom dead center), the pressure in the combustion chamber 34 is increased (i.e., positive pressure is increased).

At a position P1 where the pressure (positive pressure) in the combustion chamber 34 in the compression stroke becomes substantially equal to the pressure (positive pressure) in the combustion chamber 34 in the expansion stroke, the crankshaft 32 stops reverse rotation. The starter motor controller 56*b* compares again the crank angle of the crankshaft 32 that has stopped reverse rotation and the threshold with each other, and if the crank angle does not reach the threshold, the starter motor controller 56*b* drives the generator motor 16 (i.e., forwardly rotates the crankshaft 32) again until the exhaust valve 44 of the cylinder 26 in the expansion stroke opens.

The starter motor controller 56*b* repeats an operation for driving the generator motor 16 to forwardly rotate the crankshaft 32 and an operation for stopping driving the generator motor 16 to reversely rotate the crankshaft 32 until the crank angle reaches the threshold.

When the crank angle reaches the threshold, the starter motor controller 56*b* ends the pre-restart control. When the pre-restart control ends, the engine controller 56*a* restarts the engine 12.

As described above, the engine driving apparatus 10 according to the embodiment includes the starter motor controller 56*b*. The starter motor controller 56*b* performs the pre-restart control so as to change the crank angle to the threshold. That is, by performing the pre-restart control, the starter motor controller 56*b* can make the crank angle approach the top dead center of the compression stroke and the bottom dead center of the expansion stroke.

Thus, the starter motor controller 56*b* can reduce energy for restarting the engine 12. As a result, even if the output of the generator motor 16 is low, the starter motor controller 56*b* can restart the engine 12 with ease.

Although the embodiment of the disclosure has been described above with reference to the accompanying drawings, it is needless to say that the disclosure is not limited to the embodiment. It is obvious to a person skilled in the art that various modifications or alternations can be arrived at within the scope of the claims, and those modifications or alternations naturally fall within the technical scope of the disclosure.

The above embodiment has described a case in which the starter motor controller 56*b* determines whether it is possible to perform the pre-restart control. However, the disclosure is not limited to this, and the starter motor controller 56*b* may not determine whether it is possible to perform the pre-restart control.

The above embodiment has described a case in which the starter motor controller 56*b* repeats the pre-restart control (i.e., forward rotation operation and reverse rotation operation of the crankshaft 32). However, the disclosure is not limited to this, and the starter motor controller 56*b* may not repeat the pre-restart control.

The starter motor controller 56*b* illustrated in FIG. 2 can be implemented by circuitry including at least one semiconductor integrated circuit such as at least one processor (e.g., a central processing unit (CPU)), at least one application specific integrated circuit (ASIC), and/or at least one field programmable gate array (FPGA). At least one processor can be configured, by reading instructions from at least one machine readable tangible medium, to perform all or a part of functions of the starter motor controller 56*b*. Such a medium may take many forms, including, but not limited to, any type of magnetic medium such as a hard disk, any type of optical medium such as a CD and a DVD, any type of semiconductor memory (i.e., semiconductor circuit) such as a volatile memory and a non-volatile memory. The volatile memory may include a DRAM and a SRAM, and the non-volatile memory may include a ROM and a NVRAM. The ASIC is an integrated circuit (IC) customized to perform, and the FPGA is an integrated circuit designed to be configured after manufacturing in order to perform, all or a part of the functions of the modules illustrated in FIG. 2.

The invention claimed is:

1. An engine driving apparatus comprising:

an engine comprising a plurality of cylinders in which, when any one of the plurality of cylinders enters a compression stroke, another one of the cylinders enters an expansion stroke;

a starter motor coupled to a crankshaft of the engine;

a crank angle sensor configured to sense a crank angle of the crankshaft;

a temperature sensor, disposed in the starter motor, configured to sense a temperature of the starter motor; and a starter motor controller configured to control the starter motor and perform pre-restart control, wherein, before restarting the engine, the starter motor controller performs the pre-restart control, wherein the pre-restart control comprises adding torque to the crankshaft by using the starter motor to open an exhaust valve of the cylinder in the expansion stroke, and wherein, before restarting, the engine, on a basis of a signal output from the crank angle sensor, the starter motor controller determines whether it is possible to perform the pre-restart control.

2. The engine driving apparatus according to claim 1, further comprising:

a status sensor configured to sense a status of a battery that supplies power to the starter motor, wherein, before restarting the engine, on a basis of signals output from the crank angle sensor, the temperature sensor, and the status sensor, the starter motor controller determines whether it is possible to perform the pre-restart control.

3. The engine driving apparatus according to claim 2, wherein, on the basis of the signals output from the temperature sensor and the status sensor, the starter motor controller, configured to derive the temperature of the starter motor and a degree of degradation of the battery, derives the temperature of the starter motor and the degree of degradation of the battery, wherein, the starter motor controller determines whether the temperature and the degree of degradation are within a predetermined first region, and wherein, when it is determined that the temperature and the degree of degradation are within the predetermined first region, the starter motor controller determines to perform the pre-restart control, and when it is determined that the temperature and the degree of degradation are within a second region that is smaller than the first region, the starter motor controller determines not to perform the pre-restart control.

4. The engine driving apparatus according to claim 3, further comprising:

an engine controller configured to control the engine, wherein, when it is determined that the temperature and the degree of degradation are within a third region that is larger than the first region, the engine controller does not implement idle reduction of the engine, and wherein, when it is determined that the temperature and the degree of degradation are within the third region, the starter motor controller determines not to perform the pre-restart control.

5. The engine driving apparatus according to claim 1, wherein, during the pre-restart control, the starter motor controller, configured to drive the starter motor, drives the starter motor to forwardly rotate the crankshaft and then stops driving the starter motor to reversely rotate the crankshaft until the crankshaft stops, and wherein the starter motor controller repeats the pre-restart control until a crank angle of the crankshaft reaches a threshold.

6. The engine driving apparatus according to claim 2, wherein, during the pre-restart control, the starter motor controller, configured to drive the starter motor, drives the starter motor to forwardly rotate the crankshaft and then stops driving the starter motor to reversely rotate the crankshaft until the crankshaft stops, and wherein the starter motor controller repeats the pre-restart control until a crank angle of the crankshaft reaches a threshold.

7. The engine driving apparatus according to claim 3, wherein, during the pre-restart control, the starter motor controller, configured to drive the starter motor, drives the starter motor to forwardly rotate the crankshaft and then stops driving the starter motor to reversely rotate the crankshaft until the crankshaft stops, and wherein the starter motor controller repeats the pre-restart control until a crank angle of the crankshaft reaches a threshold.

8. The engine driving apparatus according to claim 4, wherein, during the pre-restart control, the starter motor controller, configured to drive the starter motor, drives the starter motor to forwardly rotate the crankshaft and then stops driving the starter motor to reversely rotate the crankshaft until the crankshaft stops, and wherein the starter motor controller repeats the pre-restart control until a crank angle of the crankshaft reaches a threshold.

9. An engine driving apparatus comprising:

an engine comprising a plurality of cylinders in which, when any one of the plurality of cylinders enters a compression stroke, another one of the cylinders enters an expansion stroke;

a starter motor coupled to a crankshaft of the engine;

a crank angle sensor configured to sense a crank angle of the crankshaft;

a temperature sensor, disposed in the starter motor, configured to sense a temperature of the starter motor; and circuitry configured to:

control the starter motor, and before restarting the engine, on a basis of a signal output from the crank angle sensor, determine whether it is possible to perform pre-restart control, the pre-restart control comprising adding torque to the crankshaft by using the starter motor to open an exhaust valve of the cylinder in the expansion stroke.

10. The engine driving apparatus according to claim 2, wherein, on the basis of the signals output from the temperature sensor and the status sensor, the starter motor controller, configured to derive the temperature of the starter motor and a degree of degradation of the battery, derives the temperature of the starter motor and the degree of degradation of the battery, wherein, the starter motor controller determines whether the temperature and the degree of degradation are within a predetermined first region, and wherein, when it is determined that the temperature and the degree of degradation are within the predetermined first region, the starter motor controller derives a predetermined threshold for a crank angle of the engine.

11. The engine driving apparatus according to claim 10, wherein the threshold set for each predetermined crank angle region varies depending on the temperature of the starter motor and the degree of degradation of the battery.

12. An engine driving apparatus comprising:

an engine comprising a plurality of cylinders in which, when any one of the plurality of cylinders enters a compression stroke, another one of the cylinders enters an expansion stroke;

a starter motor coupled to a crankshaft of the engine;

a crank angle sensor configured to sense a crank angle of the crankshaft;

a temperature sensor configured to sense a temperature of the starter motor;

a status sensor, disposed in a battery, configured to sense a status of the battery that supplies power to the starter motor; and a starter motor controller configured to control the starter motor and perform pre-restart control, wherein, before restarting the engine, the starter motor controller, configured to perform pre-restart control, performs the pre-restart control, wherein the pre-restart control comprises adding torque to the crankshaft by using the starter motor to open an exhaust valve of the cylinder in the expansion stroke, and wherein, before restarting the engine, on a basis of a signal output from the crank angle sensor, the starter motor controller determines whether it is possible to perform the pre-restart control.

13. The engine driving apparatus according to claim 12, wherein, before restarting the engine, on a basis of signals output from the crank angle sensor, the temperature sensor, and the status sensor, the starter motor controller determines whether it is possible to perform the pre-restart control.

14. The engine driving apparatus according to claim 12, wherein, during the pre-restart control, the starter motor controller, configured to drive the starter motor, drives the starter motor to forwardly rotate the crankshaft and then stops driving the starter motor to reversely rotate the crankshaft until the crankshaft stops, and wherein the starter motor controller repeats the pre-restart control until a crank angle of the crankshaft reaches a threshold.

15. The engine driving apparatus according to claim 13, wherein, on the basis of the signals output from the temperature sensor and the status sensor, the starter motor controller, configured to derive the temperature of the starter motor and a degree of degradation of the battery, derives the temperature of the starter motor and the degree of degradation of the battery, wherein, the starter motor controller, configured to determine whether the temperature and the degree of degradation are within a predetermined first region, determines whether the temperature and the degree of degradation are within the predetermined first region, and wherein, when it is determined that the temperature and the degree of degradation are within the predetermined first region, the starter motor controller determines to perform the pre-restart control, and when it is determined that the temperature and the degree of degradation are within a second region that is smaller than the first region, the starter motor controller determines not to perform the pre-restart control.

16. The engine driving apparatus according to claim 13, wherein the temperature sensor is configured to detect the temperature of the starter motor, wherein the status sensor is configured to detect a degradation status of the battery, wherein the crank angle sensor is configured to detect a crank angle of the crankshaft, wherein, during the pre-restart control, the starter motor controller, configured to drive the starter motor, drives the starter motor to forwardly rotate the crankshaft and then stops driving the starter motor to reversely rotate the crankshaft until the crankshaft stops, and wherein the starter motor controller repeats the pre-restart control until a crank angle of the crankshaft reaches a threshold.

17. The engine driving apparatus according to claim 13, wherein, on the basis of the signals output from the temperature sensor and the status sensor, the starter motor controller, configured to derive the temperature of the starter motor and a degree of degradation of the battery, derives the temperature of the starter motor and the degree of degradation of the battery, wherein, the starter motor controller, configured to determine whether the temperature and the degree of degradation are within a predetermined first region, determines whether the temperature and the degree of degradation are within a predetermined first region, and wherein, when it is determined that the temperature and the degree of degradation are within the predetermined first region, the starter motor controller derives a predetermined threshold for a crank angle of the engine.

18. The engine driving apparatus according to claim 15, further comprising:

an engine controller configured to control the engine, wherein, when it is determined that the temperature and the degree of degradation are within a third region that is larger than the first region, the engine controller does not implement idle reduction of the engine, and wherein, when it is determined that the temperature and the degree of degradation are within the third region, the starter motor controller determines not to perform the pre-restart control.

19. The engine driving apparatus according to claim 15, wherein, during the pre-restart control, the starter motor controller, configured to drive the starter motor, drives the starter motor to forwardly rotate the crankshaft and then stops driving the starter motor to reversely rotate the crankshaft until the crankshaft stops, and wherein the starter motor controller repeats the pre-restart control until a crank angle of the crankshaft reaches a threshold.

20. The engine driving apparatus according to claim 18, wherein, during the pre-restart control, the starter motor controller, configured to drive the starter motor, drives the starter motor to forwardly rotate the crankshaft and then stops driving the starter motor to reversely rotate the crankshaft until the crankshaft stops, and wherein the starter motor controller repeats the pre-restart control until a crank angle of the crankshaft reaches a threshold.

* * * * *